United States Patent [19]

Carter

[11] 3,975,117

[45] Aug. 17, 1976

[54] PUMP AND MOTOR UNIT WITH INDUCER AT ONE END AND CENTRIFUGAL IMPELLER AT OPPOSITE END OF THE MOTOR

[76] Inventor: James Coolidge Carter, 1735 San Pasqual St., Pasadena, Calif. 91106

[22] Filed: Sept. 27, 1974

[21] Appl. No.: 509,853

[52] U.S. Cl. ..... 417/370; 417/424; 417/901; 415/143

[51] Int. Cl.[2] ..... F04B 17/00; F04B 15/08

[58] Field of Search ..... 417/370, 369, 368, 901, 417/424; 415/104, 106, 143

[56] References Cited

UNITED STATES PATENTS

| | | | |
|---|---|---|---|
| 1,135,296 | 4/1915 | Krogh | 415/106 |
| 2,340,787 | 2/1944 | Zenner et al. | 415/106 |
| 2,450,137 | 9/1948 | Harlamoff | 417/368 X |
| 3,022,739 | 2/1962 | Herrick et al. | 417/369 |
| 3,369,715 | 2/1968 | Carter | 222/333 |

FOREIGN PATENTS OR APPLICATIONS

| | | | |
|---|---|---|---|
| 999,493 | 7/1965 | United Kingdom | 417/370 |

*Primary Examiner*—Carlton R. Croyle
*Assistant Examiner*—Thomas I. Ross
*Attorney, Agent, or Firm*—Hill, Gross, Simpson, Van Santen, Steadman, Chiara & Simpson

[57] ABSTRACT

Motor driven inducer equipped centrifugal pumps have the inducer and centrifugal pump impellers mounted on a motor shaft on opposite ends of the motor so that the inducer will not create prerotation in the impeller entrance permitting both the inducer and the impeller to operate independently and produce a head which is the sum of the two individual heads produced by the inducer and the impeller. The heretofore required relationship between the inducer outer diameter and the impeller inner diameter is eliminated and inducer sizes may be varied for best efficiency. Pumpage is vented to the motor through a hollow motor shaft to cool the motor and lubricate the bearings. Multi-staging of the pump is simplified with standard parts being stacked to produce the desired number of stages and, in the multi-stage embodiment, the second stage impeller is subjected to an upward thrust by the pumpage from the first stage to balance inducer thrust loads on the bearings with opposite impeller thrust loads.

11 Claims, 4 Drawing Figures

Fig. 3
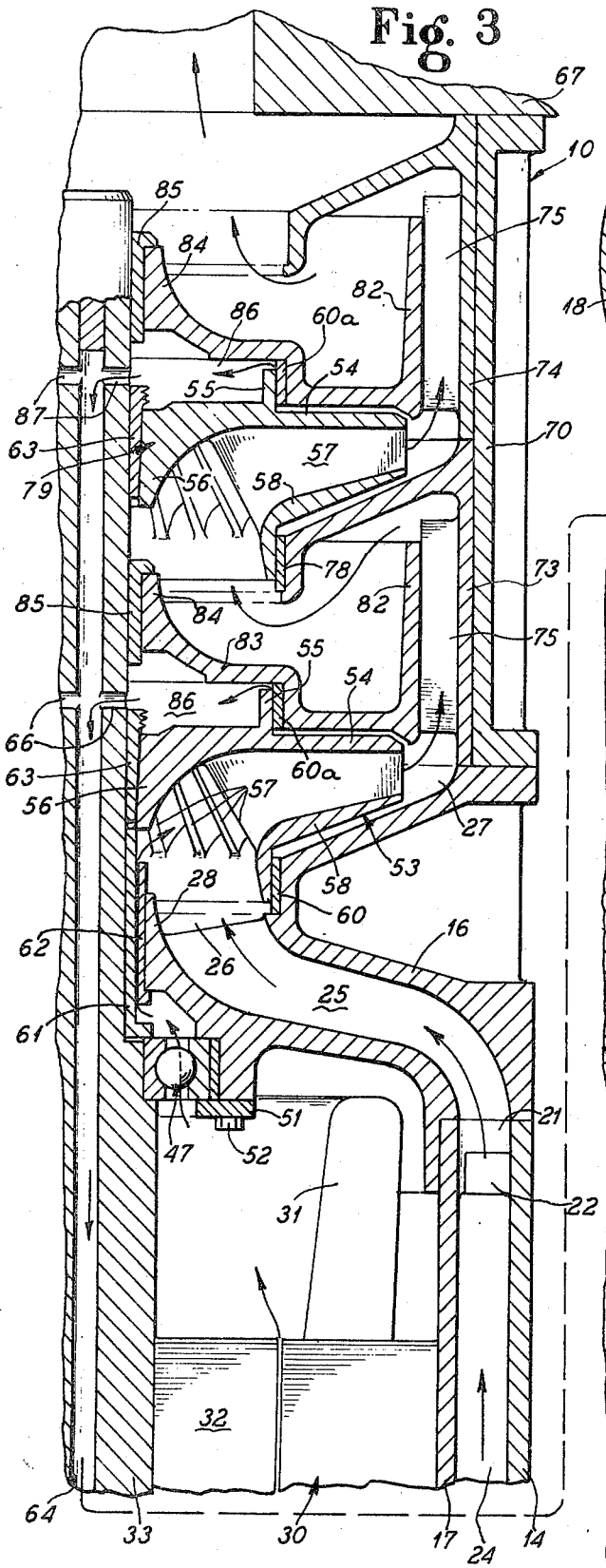
Fig. 2
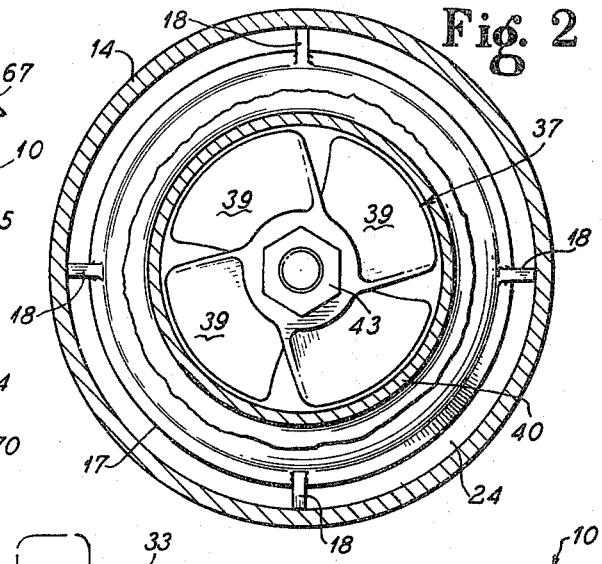
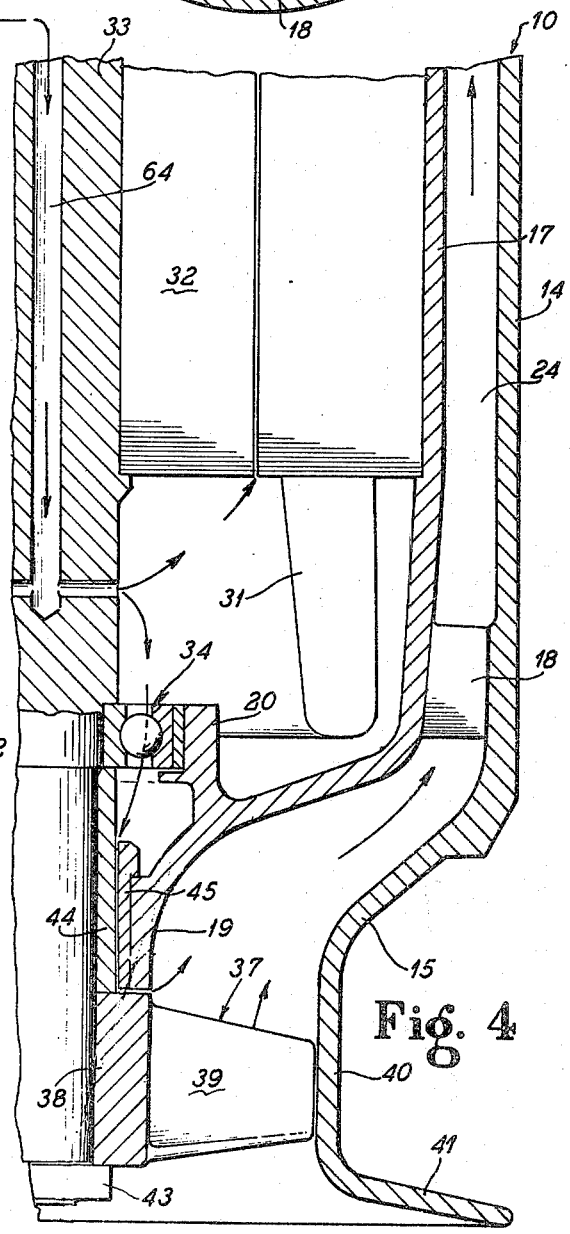
Fig. 4

PUMP AND MOTOR UNIT WITH INDUCER AT ONE END AND CENTRIFUGAL IMPELLER AT OPPOSITE END OF THE MOTOR

BACKGROUND OF THE INVENTION

1. Field of the Invention

This invention relates to the art of submersible electric motor driven inducer equipped centrifugal pump units especially useful as cargo pumps for tanker ships and storage tanks and capable of pumping cargo such as cryogenic fluids or fluids at their boiling points. Particularly, the invention deals with the mounting of the inducer and centrifugal pump impellers on a motor shaft at opposite ends of the electric motor to eliminate inducer developed prerotation of the fluid in the impeller inlet, to make possible the use of a variety of inducer sizes without concern for the heretofore required relationship between an inducer outer diameter and impeller inner diameter, to simplify multi-staging of the pump and to balance inducer thrust with impeller thrust in a multistage pump.

2. Prior Art

My prior U.S. Pat. Nos. 3,304,877 issued Feb. 21, 1967; 3,369,715 issued Feb. 20, 1968; and 3,764,236 issued Oct. 9, 1973 disclose and claim submersible electric motor driven cargo pumps for the pumping of cryogenic fluids or fluids at their boiling points wherein an inducer impeller is mounted on and driven by the electric motor driven pump shaft in the pump inlet immediately ahead of the pump impeller. In these pumps, relatively small diameter inducer impellers are mounted in a relatively small pump inlet to discharge into an inner diameter inlet of the adjacent pump impeller. The adjacent mounting of the inducer and pump impellers required a restricted relation between the inducer outer diameter and the impeller inner diameter, thus, limiting the inducer size and the inlet diameter of the pump. The inducer created considerable prerotation of the fluid in the impeller entrance making the sum of the inducer and impeller heads no more than that of the impeller alone. While the pumps of these patents provided a good single stage pump under most conditions, they were not easily converted to multiple stage pumps and were not suitable for severe operating combinations of head and capacity conditions encountered in some installations. Further, the lower pump shaft bearing adjacent the pump impeller was subjected to severe loads from the inducer.

SUMMARY OF THIS INVENTION

This invention now avoids the heretofore encountered restricted relationship between inducer outer diameter and impeller inner diameter sizes, eliminates the effect of rotation of the fluid by the inducer on the pump impeller, simplifies multi-staging, and balances inducer thrust loads on the motor shaft bearings with impeller thrust loads, in a submersible electric motor driven centrifugal cargo pump. The electric motor driven pump units of this invention are suspended vertically in a "pot" of a fluid flow system or are mounted directly in a pond of the fluid to be pumped, as for example, in the bottom of a tank or hold of a ship. The units receive the cargo to be pumped through a bottom inlet and discharge the pumpage through a top outlet. The electric motor is mounted in an upright housing and has a hollow shaft supported in a floating bearing at the bottom of the housing and in a fixed bearing at the top of the housing. The motor housing is surrounded by a casing with a necked down inducer housing at the bottom end and a bell casing at the upper end. Vanes radiating from the motor housing locate the inducer end thereof in the casing. The bottom of the hollow motor shaft carries the inducer in the inducer housing to discharge between the vanes which convert rotation of the fluid into axial flow through the passage between the motor housing and the surrounding casing.

A centrifugal pump impeller is mounted in the bell housing on a hollow motor shaft and receives the fluid from the axial flow path between the motor housing and casing. In the single stage embodiment of the invention, the centrifugal impeller discharges between different vanes to a top outlet. In the multiple stage embodiment of the invention, any number of desired impellers are mounted on the motor shaft above the first stage impeller and cooperate with spacer sleeves to successively receive the discharge from the previous stage and discharge the fluid to the next successive stage or to the final outlet. The bell housing carries on the top end thereof a cylindrical housing of a length to accommodate the desired number of stages for the pump. Vanes on the sleeves between the pump stages convert rotation of the pumpage from the previous stage into axial flow.

The hollow motor shaft is vented to a chamber above the top shroud of at least the first stage impeller and to the interior of the motor casing for flowing pumpage through the motor casing to act as a coolant and a bearing lubricant. The pressure in the shroud chamber is thus limited to approximate inlet pressure providing for impeller balance. Some of the bled-off pumpage may drain through a bottom bearing to the inducer and some will flow through the top bearing to the pump impeller. Since the first stage impeller is vented to the motor compartment and since the impellers of the subsequent stages are mounted on the motor shaft and are subjected to higher pressures, the motor compartment will always be at a lower pressure than the pressures encountered by the second and subsequent stage impellers causing these impellers to exert an upward lifting action on the motor shaft counteracting the downward thrust from the inducer. The motor shaft bottom bearing adjacent the inducer is a floating radial guide bearing and axial thrust loads are covered by a top bearing. This prevents one bearing from loading the other.

It is then an object of this invention to avoid the heretofore required necessity of correlating inducer sizes with centrifugal impeller inlet sizes in inducer equipped centrifugal pumps.

Another object of the invention is to simplify the multi-staging of electric motor driven submersible inducer equipped centrifugal pumps.

A further object of the invention is to balance thrust loads on the bearings of an electric motor driven inducer equipped centrifugal pump.

Another object of the invention is to provide an electric motor driven impeller equipped centrifugal cargo pump with inducer and centrifugal impellers at opposite ends of the motor.

A further object of the invention is to provide an upright electric motor driven inducer equipped centrifugal pump unit for mounting in a pot of a flow line or in a tank wherein an inducer impeller of a size designed for the most efficient operation in the particular installation is mounted in an inlet at the bottom of the unit, one or more centrifugal pump impellers are mounted in the top of the unit, the electric motor in the unit is between the inducer and centrifugal impellers, and rotation of the fluid created by the inducer impeller is stopped before it reaches the centrifugal impeller so that each impeller will create its own independent head on the fluid.

Other and further objects of this invention will be apparent to those skilled in this art from the following detailed description of the annexed sheets of drawings which, by way of a preferred example, illustrate one embodiment of the invention.

IN THE DRAWINGS

FIG. 2 is a transverse sectional view along the line II—II of FIG. 1;

FIG. 3 is an enlarged fragmentary sectional view of the upper end of the pump of FIG. 1; and FIG. 4 is an enlarged fragmentary sectional view of the lower end of the pump of FIG. 1.

AS SHOWN IN THE DRAWINGS

Figure 1:
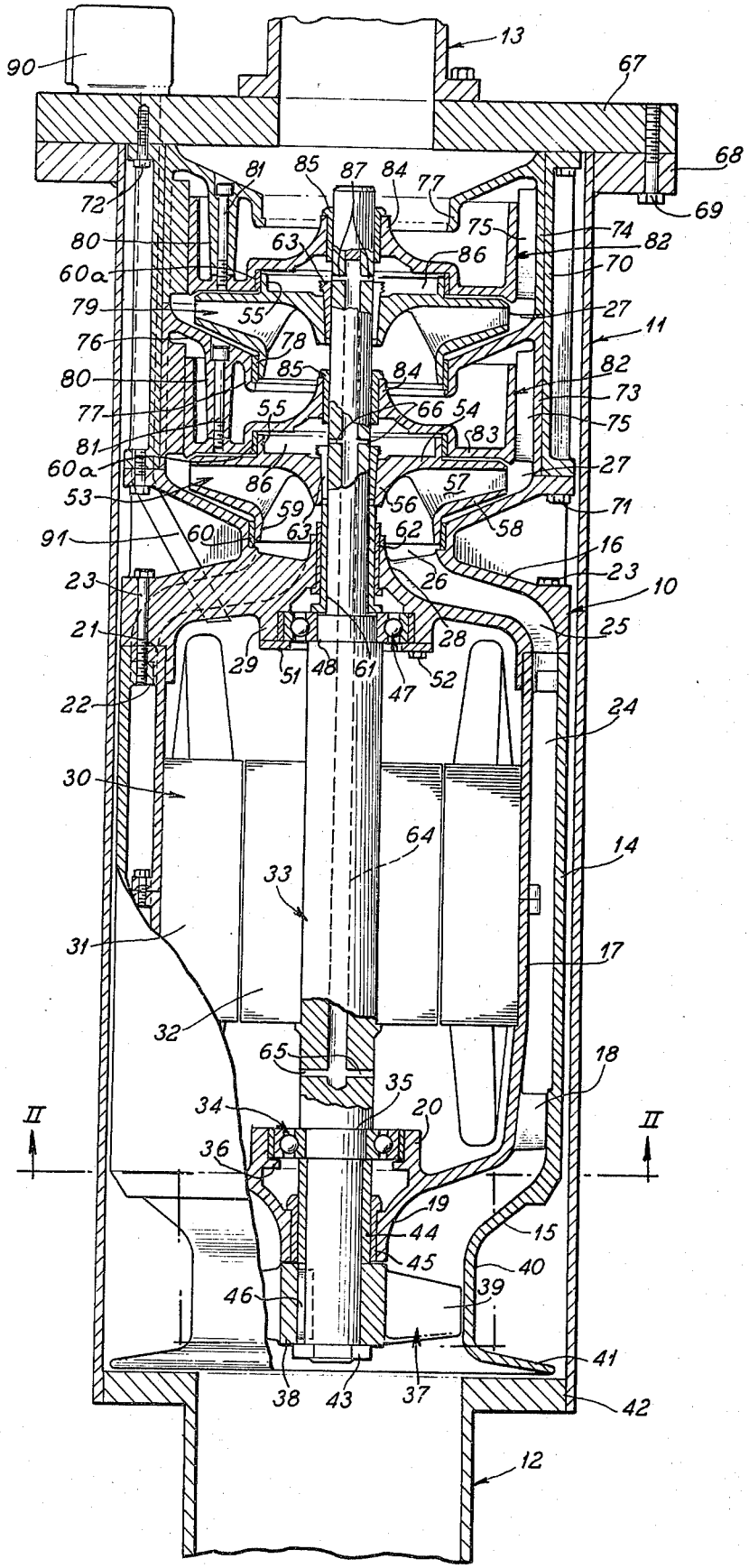
FIG. 1 is a vertical cross sectional view of a submersible electric motor driven inducer impeller equipped centrifugal cargo pump mounted in a pot according to this invention.

The submersible electric motor driven inducer equipped centrifugal cargo pump 10 of this invention is illustrated in FIG. 1 as mounted in a pot or a large casing 11 in a cargo flow line having a bottom inlet 12 and a top outlet 13. It should be understood, however, that the unit 10 of this invention is adapted for direct submersion in the fluid to be pumped such as, for example, in the bottom of the hold of a tanker ship or large storage tank.

The pump and motor unit 10 has a cylindrical casing 14 with a necked down inducer housing 15 at the bottom thereof and a bell or cap 16 bolted to the top thereof. A motor housing 17 is centered in the casing 14 by radial fins or vanes 18 seated in the inducer housing portion 15. The bottom of the motor housing 17 converges to a neck 19 extending downwardly into the central portion of the inducer housing 15. The converging bottom end of the housing 17 has an upstanding annular neck 20 in the central portion of the housing. The top of the housing 17 has an outturned flange 21 resting on an inturned flange 22 of the casing 14. The cap 16 is bottomed on the housing flange 21 and bolts 23 extending through the cap 16 and flange 21 are threaded into the flange 22 to secure the motor housing 17 in the casing 14 and secure the cap 16 on both the housing and the casing.

An annular passage 24 is provided between the casing 14 and the housing 17 and communicates through passages 25 in the cap 16 and flanges 21 and 22 with the central inlet 26 of a pumping chamber 27 defined by the cap 16.

The cap 16 has a central neck 28 extending into the inlet 26 and a depending neck 29 extending into the housing 17.

A motor 30 is mounted in the motor housing 17 and includes an annular field coil stator 31 surrounding an armature rotor 32 which is mounted on a vertical shaft 33 extending through the necks 19 and 28.

An anti-friction ball bearing assembly 34 has an inner race ring bottomed on a shoulder 35 of the shaft 33 and an outer race ring freely fitting in the neck 20 and to float toward and away from a shoulder 36 in this neck.

The inducer impeller 37 of the unit 10 has a central hub 38 keyed on the shaft below the neck 19 of the housing 17 with four inducer vanes 39 radiating from this hub 38 into closely spaced relation with the cylindrical inlet wall 40 of the inducer housing 15. Two vanes 39 can be used in place of the illustrated four. The bottom of this cylindrical wall has an outturned downwardly sloping flange or lip 41 closely overlying the bottom 42 of the pot 11.

A nut 43 threaded on the bottom end of the shaft 33 is bottomed against the hub 38 of the inducer impeller 37 and clamps this hub against a spacer sleeve 44 on the shaft 33 which sleeve is bottomed on the inner race ring of the bearing assembly 34. A bearing bushing 45 secured in the neck 19 rotatably receives the sleeve 44. A key 46 seated in key slots of the shaft 33 and the hub 38 locks the shaft and inducer impeller 37 together for corotation.

A ball bearing assembly 47 has an inner race ring bottomed on a shoulder 48 of the shaft 33 and an outer race ring secured in the neck 29 of the cap 16 by a ring 51 attached to the bottom of the neck 29 by screws 52.

The shaft 33 extends beyond the neck 28 through the hub of a first stage shrouded centrifugal impeller 53. This impeller 53 has a flat top disk portion 54 with an upstanding annular collar or shroud 55, a central depending hub 56 with a tapered bore, a plurality of circumferentially spaced depending impeller vanes 57, and a bottom shroud 58 covering the vanes and converging to a central cylindrical neck 59 in the pump inlet 26. This neck 59 rides in a wear ring 60 carried by the cap 16 in the inlet 26. The collar 55 rides in a similar wear ring **60*a* carried by an overlying cup member as hereinafter described. The hub 56 is bottomed on a spacer sleeve 61 on the shaft 33 which has an outturned foot bottomed on the inner race ring of the bearing assembly 47. A bearing bushing 62 seated in the neck 28 surrounds and guides the sleeve 61. A split tapered steel bushing 63 with a cylindrical inner diameter embracing the shaft 33 and a tapered outer diameter seated in the tapered bore of the impeller hub 56** clamps the impeller to the shaft.

The shaft 33 has a central axial bore 64 terminating above the bearing 34 and connected by radial passages 65 with the bottom of the motor housing 17. The bore 64 is also connected through radial passages 66 with the top of the disk portion 54 of the impeller 53 radially inward from the collar 55.

As shown in FIG. 1, a cover plate 67 for the pot 11 has a mounting flange 68 around its top end connected to the cover 67 by bolts 69. The cover 67 has a central aperture discharging to the fluid outlet 13.

As shown in FIGS. 1 and 3, a spacer sleeve 70 of sufficient length to accommodate the desired number of pump stages is interposed between the cover 67 and the bell housing 16. This sleeve has outturned flanges at both ends thereof bolted respectively by bolts 71 and 72 to the top of the cap 16 and the bottom of the cover plate 67.

In the illustrated two stage pump arrangement of FIGS. 1 and 3, a first spacer ring 73 is mounted in the sleeve 70 and bottomed on the cap 16 while a second spacer ring 74 is bottomed on the first ring 73. A slight clearance is allowed in the stack-up to permit the rings 73 and 74 to take their concentricity from the shaft 33 and they are clamped against the cap 16 by the hydraulic pressure generated by the pump impeller. Each of these rings 73 and 74 have circumferentially spaced inwardly projecting vanes or ribs 75 and a downwardly sloping top wall 76 converging to a neck 77 carrying a wear ring 78.

A second stage impeller 79 identical with the first stage impeller 53 has its shrouded bottom riding in the wear ring 78 and its hub 56 wedge locked to the shaft 33 by a split bushing 63.

The sleeve rings 73 and 74 have posts 80 depending from their sloping top walls 76 and bolts 81 extend through these posts to support cup-like members 82 with upstanding cylindrical side walls snugly seated in the ribs 75 and with bottom walls 83 stepped upwardly to support the wear rings 60*a* and to provide central necks 84 mounting bushings 85 surrounding the shaft 33. These bottom walls provide chambers 86 above the tops 54 of the impellers 53 and 79. The bottom chamber 86 communicates with the bore 64 of the shaft 33 by the radial passages 66 while the top chamber 86 communicates with this bore through similar passages 87.

It will be understood that in the single stage embodiment the second impeller 79 and the second spacer ring 74 with its cup 82 are omitted and the first impeller discharges its pumping chamber 27 between diffuser vanes 75 to the top outlet 13.

The cover 67 for the pot 11 supports a conduit box 90 from which an electrical conduit 91 extends into the motor housing 17 to energize the motor.

OPERATION

The pump and motor unit 10 of this invention mounted in the pot 11 receives fluid cargo to be pumped from an inlet conduit 12. This fluid is directed into the cylindrical portion 40 of the inducer housing 15 by the outturned foot flange or lip 41. The pot 11 provides the container from which the pump 10 receives its supply of fluid and is usually filled with the fluid to be pumped so that a head of fluid will be at a level above the level of the inducer impeller 37 to insure the impeller being submerged in the fluid.

The motor 30 is energized through the conduit 91 from the conduit box 90 to rotate the rotor 32 and drive the motor shaft 33. The inducer impeller 37 suspended on the bottom of the motor shaft 33 is rotated so that its vanes 39 will induce an upward flow of the fluid through the annular passage 24 between the motor housing 17 and the surrounding casing 14. The vanes 18 in this passage 24 will diffuse rotation of the fluid created by the rotating vanes 39 into axial flow. The axially flowing fluid passes through the inwardly converging passageways 25 provided in the cap 16 to the inlet 26 of the first pump stage where the fluid enters the eye of the shrouded impeller 53 and is centrifugally pumped by the vanes 57 of this impeller to a surrounding annular pumping chamber 27. This chamber 27 may discharge between diffuser vanes 75 to the pump outlet 13 in a single pump stage embodiment of this invention but in the illustrated multi-stage pump of FIGS. 1 and 3, the discharge from the pumping chamber 27 is upwardly between these vanes 75 and then downwardly into the cup member 82 where it flows into the inlet of the second stage pump to feed the eye of the second stage impeller 79. From this second stage impeller 79, the fluid is discharged into another pumping chamber 27 from which it again flows upwardly between diffuser vanes 75 and is then directed through the neck 77 of the top sleeve 74 to flow to the outlet 13.

Some of the fluid from the pumping chambers 27 will flow between the adjacent impellers and the overlying walls 83 of the cup members 82 into the chambers 86 which communicate with the bores 64 in the motor shaft 33 through the passages 66 and 87. This fluid is discharged from the motor shaft bore 64 through the passages 65 into the bottom of the motor housing 17 and can flood this motor housing to eventually leak through the bottom bearing 34 and bearing bushing 45 back to the inducer to merge with the incoming fluid impelled by the inducer and thus be recirculated back through the passage 24. Likewise, the bled-off fluid in the top of the motor housing 17 can flow through the bearing 47 and bushing 62 back to the first stage pump inlet 26 to merge with the fluid from the passages 25. In this manner, the motor compartment is cooled and the bearings are lubricated.

The inducer vanes 39 acting on the fluid in the inlet and propelling this fluid to the inlet of the first pumping stage will create a downward thrust load on the motor shaft 33. This thrust load is supported by the top bearing 47 since the bottom bearing 34 is floating and only acts as a radial guide for the shaft. However, in accordance with this invention, the thrust load on this bearing 47 is relieved by an opposite or lifting load applied to the top impeller 79 by the fluid discharged from the first stage impeller 53. Since the chambers 86 above each impeller 53 and 79 communicate with the motor housing 17 which is at a relatively low pressure and since the pressure of the fluid discharged from the first stage impeller is substantially higher than the motor housing pressure, a lifting force will be exerted on the impeller 79 tending to raise the pump shaft 33 and reduce the load on the bearing 47 from the downward thrust of the inducer.

Since the inducer 37 is mounted at one end of the motor casing 17 while the pump impeller or impellers are mounted at the opposite side of the motor casing on the same shaft 33, the overall diameter of the inducer impeller is not limited by the inlet diameter of the pump impeller or impellers and these outer and inner diameters may be selected for the most efficient operation in any given installation. Further, since the rotation of the fluid created by the inducer is converted into a straight axial flow by the vanes 18, both the inducer and the impeller can establish their own independent fluid heads and the head established by the inducer will be added to the head established by the impeller to increase the efficiency of the pump.

It will also be understood that the provision of the pumping stage on the top of the motor makes possible a standard basic design which can be easily altered to include as many pumping stages as desired by the mere addition of impellers, and their surrounding spacer rings 73 and 74 and the cup members 82 carried by these rings.

I claim as my invention:

1. A pump and motor unit with an inlet at one end and an outlet at the opposite end which comprises an axial flow inducer impeller in said inlet of the unit, a centrifugal impeller in said unit adjacent said outlet, a motor between said axial flow inducer and said centrifugal impeller, said centrifugal impeller having an inlet side facing the inducer impeller and receiving fluid directly from the inducer impeller for discharge to said outlet, a motor shaft extending beyond both ends of the motor of said unit supporting said inducer impeller at one end and supporting the centrifugal impeller at the opposite end, said centrifugal impeller exerting an axial thrust load on said motor shaft opposing the axial thrust load of the inducer impeller, and means in said unit providing a direct continuous substantially axial flow path from the inducer impeller to the centrifugal impeller.

2. The unit of claim 1 including a casing, a housing in said casing for said motor and cooperating with the casing to define said flow path therebetween, and radial vanes extending across said flow path to convert rotational flow of fluid from the inducer impeller into axial flow of the fluid to the inlet of the centrifugal impeller.

3. The unit of claim 2 wherein the housing for said motor is centered in said casing by said vanes.

4. The unit of claim 1 including passageways bleeding pumpage from the discharge side of said centrifugal impeller through said motor and back to the discharge side of said inducer impeller for cooling the motor without releasing pumpage to the pump inlet.

5. The unit of claim 1 wherein bearings support said motor shaft adjacent the opposite ends of the motor shaft with one of said bearings being freely axially shiftable and the other of said bearings being axially fixed to support thrust loads on the motor shaft.

6. The unit of claim 1 including a plurality of centrifugal impellers on said one end of said motor shaft, each of said centrifugal impellers having inlets facing said inducer impeller and said plurality of said centrifugal impellers exerting the axial thrust load on said motor shaft opposing the axial thrust load of the inducer impeller.

7. A submersible electric motor driven inducer equipped centrifugal pump adapted for pumping cryogenic fluids and fluids at their boiling points which comprises a casing adapted to be mounted upright having a bottom inlet and a top outlet, an electric motor housing in said casing in spaced concentric relation therewith, a motor shaft projecting beyond both ends of the motor housing, an axial flow inducer impeller mounted on the bottom end of the motor shaft in said bottom inlet of the casing, a centrifugal impeller mounted on the top end of said shaft above the motor housing having an inlet facing the discharge side of the inducer impeller, said motor housing and said casing providing therebetween a direct flow path between the discharge side of the inducer impeller and the inlet side of the centrifugal impeller free from turns which reverse flow in a direction toward the inducer impeller, means providing a flow path from the discharge side of said centrifugal impeller to said top outlet of the casing, means bleeding pumpage from the discharge side of the centrifugal impeller to the interior of the motor housing for cooling the motor, means returning the bled-off pumpage from the interior of the motor housing back to the discharge side of the inducer impeller, and said centrifugal impeller exerting an axial thrust load on said motor shaft opposing the axial thrust load of the inducer impeller.

8. The pump of claim 7 including anti-friction bearings in the motor housing adjacent opposite ends thereof rotatably supporting the shaft, means axially securing one of said bearings to support thrust loads on the shaft, and means slidably mounting the other of said bearings to relieve said other bearing from axial thrust loads on the shaft.

9. The pump of claim 7 having a plurality of superimposed centrifugal impellers on the top end of the shaft each constructed and arranged with inlets facing the inducer impeller.

10. The pump of claim 7 including an additional centrifugal impeller mounted on said motor shaft above said centrifugal impeller, both of said centrifugal impellers having inlets facing said inducer impeller, and means stacked on top of said casing providing a flow path from the discharge side of said centrifugal impeller to the inlet side of said additional centrifugal impeller and from the outlet side of said additional impeller to said top outlet of the casing.

11. The pump of claim 10 wherein the additional centrifugal impeller is lifted by pumpage from the centrifugal impeller to offset the downward thrust on the motor shaft from said inducer impeller.

* * * * *